US007461595B2

(12) United States Patent
Jentzsch et al.

(10) Patent No.: US 7,461,595 B2
(45) Date of Patent: Dec. 9, 2008

(54) METHOD FOR OPERATING A PRINTING PRESS

(75) Inventors: Arndt Jentzsch, Coswig (DE); Christian Ziegenbalg, Weinböhla (DE); Victor Hefftler, Coswig (DE); Michael Koch, Cossebaude (DE)

(73) Assignee: Koenig & Bauer AG, Radebeul (DE)

( * ) Notice: Subject to any disclaimer, the term of this patent is extended or adjusted under 35 U.S.C. 154(b) by 317 days.

(21) Appl. No.: 11/091,185

(22) Filed: Mar. 28, 2005

(65) Prior Publication Data

US 2006/0213385 A1 Sep. 28, 2006

(51) Int. Cl.
*B41F 1/54* (2006.01)

(52) U.S. Cl. ..... 101/484; 101/422; 101/480; 101/485

(58) Field of Classification Search ..... 101/375, 101/376, 415.1, 416.1, 419, 420, 422, 479, 101/480, 483, 484, 485
See application file for complete search history.

(56) References Cited

U.S. PATENT DOCUMENTS 3,161,130 A 12/1964 Vogel
4,327,135 A * 4/1982 Wirz et al. ..... 428/600
5,343,807 A 9/1994 Hackelborger et al.
5,492,059 A * 2/1996 Reichel ..... 101/375
5,890,430 A 4/1999 Wirz
2003/0159605 A1 8/2003 DeMoore et al.

FOREIGN PATENT DOCUMENTS

| | | |
|---|---|---|
| DE | 19914136 | 9/2000 |
| DE | 201 07 182 U | 6/2001 |
| EP | 0 457 955 A | 11/1991 |
| GB | 2 236 508 | 4/1991 |

* cited by examiner

*Primary Examiner*—Ren Yan
(74) *Attorney, Agent, or Firm*—Goodwin Procter LLP

(57) ABSTRACT

A method for operating a printing press, which enables a uniform print quality to be achieved during long periods of operation without replacement of the impression cylinder. The printing press comprises several printing units having impression cylinders and a sheet turning device disposed between the printing units. The circumferential surface of the impression cylinder has an ink-repelling surface. The printing press is used to print sheets, until the ink-repelling surface of the circumferential surface of the impression cylinder has been worn away to an extent that the ink-repelling effect is less than a predetermined threshold value, after which a foil, of which the side facing away from the circumferential surface has an ink-repelling surface, is removably placed on the circumferential surface of the impression cylinder.

16 Claims, 1 Drawing Sheet

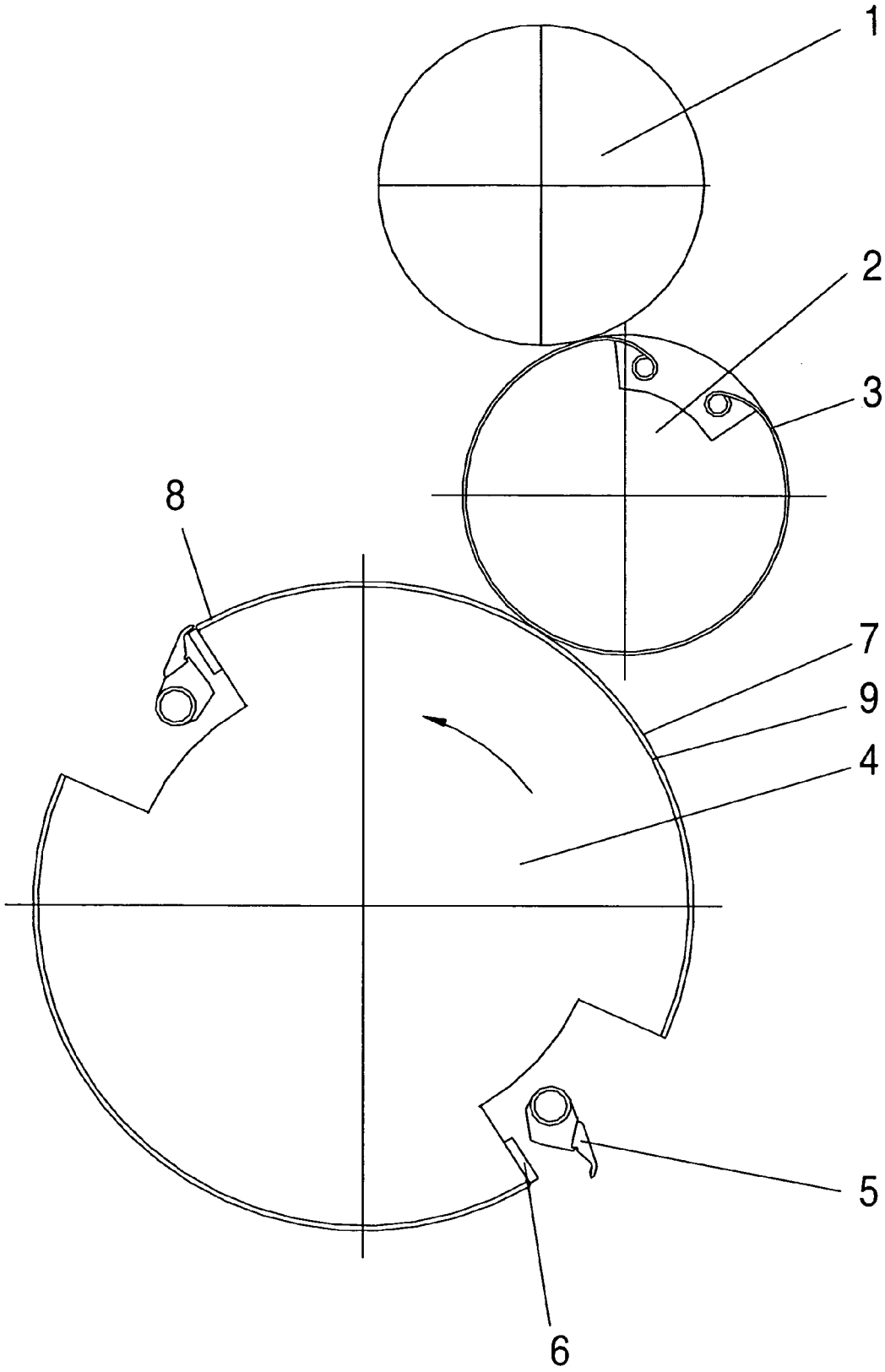
1
2
3
8
7
9
4
5
6

METHOD FOR OPERATING A PRINTING PRESS

FIELD OF THE INVENTION

The present invention relates to a method for operating a printing press comprising multiple printing units having impression cylinders and a sheet turning device disposed between the printing units.

BACKGROUND OF THE INVENTION

During the printing of printed sheets, the circumferential surfaces of the cylinders such as the impression cylinders, which guide the sheets, can come into contact with printing ink that has not dried completely. In the case of impression cylinders, which are disposed behind the turning device in perfecting presses, such contact is technologically required for producing sheets printed on both sides. In order to prevent the accumulation of printing ink on the circumferential surfaces of the impression cylinders, the circumferential surfaces of such impression cylinders are configured to be ink-repelling. This is achieved by means of the use of ink-repelling materials and/or by means of producing special rough structures, which have an ink-repelling effect and facilitate pulling the printed sheet from the impression cylinder.

DE 1 258 873 A1 discloses that the circumferential surface of an impression cylinder may be roughened by means of graining, anodizing, or sand-blasting and configured as a chrome surface. DE 42 07 119 A1 discloses a sheet-guiding impression cylinder mantle profile for an impression cylinder in sheet printing presses. The profile consists of lines that are distributed in a statistically uniform manner, forming the counter-impression surface, disposed plane-parallel to the impression cylinder axis. The lines demonstrate certain raster fineness. It is furthermore known from DE 199 14 136 A1 that a rough structure may be produced on the surface of a sheet-guiding cylinder, by coating it with plasma, and providing it with an organic, ink-repelling coating.

Since the impression cylinders are exposed to continuous wear during operation of th printing presses, because of the material wear caused by contact with the sheets to be imprinted, their ink-repelling properties gradually decrease. In the case of known impression cylinders, this results in a noticeable impairment of the printing quality after approximately four to five years of operation, making a replacement necessary. For technological reasons, the circumferential surface can be renewed only with great effort in the installed state.

In order to counter the disadvantages, based on another known solution to the problem, the impression cylinder is configured in such a manner by providing additional fastening devices, that an ink-repelling foil, acting as a counter-impression surface, can be fastened detachably to the circumferential surface of the impression cylinder. An impression cylinder of this type has a smooth surface. The thickness of the foil is taken into consideration when the circumference of the impression cylinder is dimensioned. In most cases, the foils, serving as covering for impression cylinders are made from the same materials as the circumferential surfaces of the counter-impression cylinders mentioned above, acting as counter-impression surfaces, and have the same rough structure.

A foil for this purpose is known, for example, from DE 39 31 479 A1. It consists of a chemically resistant, wear-resistant and incompressible backing layer, on which a silicone coating is applied. DE 40 36 252 A1 discloses a sheet-guiding foil as a covering for an impression cylinder of rotary offset printing presses for perfecting printing. One surface of this foil is constructed smooth and the other surface is provided with uniformly distributed spherical domes and a chrome layer that evens out the micro-roughness.

The mechanical engineering effort and expenditure for configuring the attachment devices and the unsuitability for retrofitting sheet-guiding cylinders are disadvantages of the systems consisting of an impression cylinder and a foil, in each instance.

SUMMARY OF THE INVENTION

It is an object of the present invention to avoid the aforementioned disadvantages, to provide a method for operating a perfecting press, the impression cylinder of which is disposed behind the sheet turning device and the circumferential surface of which is ink-repelling, and to make a uniform print quality possible during long periods of operation without requiring the impression cylinder to be replaced.

Pursuant to the invention, this objective is accomplished with a method for operating a printing press, the printing press comprising at least two printing units having impression cylinders and a sheet turning device disposed between the printing units, wherein a circumferential surface of at least one of the impression cylinders is disposed behind the sheet turning device ina sheet running direction has an ink-repelling surface of the circumferential surface has been worn away to such an extent that the ink-repelling effect of the ink-repelling surface is less than a predetermined threshold value, after which, a foil, of which a side facing away from the circumferential surface has an ink-repelling surface, is place removably on the circumferential surface.

The foil may be replaced by a similar foil after additional sheets have been processed, if the ink-repelling surface of the foil is worn away to such an extent that the ink-repelling effect is less that a predetermined threshold value.

An advantage of the method of the present invention is that a printing press having an ink-repelling cylinder can be operated, during the first years of operation, in known a manner, utilizing the ink-repelling properties of the circumferential surface of the impression cylinder, and once the wear limit has been reached, can be equipped for additional years of operation, by disposing a foil on it. This is advantageous particularly for the operation of perfecting presses of which the impression cylinder does not comprise any device for attaching an ink-repelling covering, because the complicated replacement of the impression cylinders associated with down time of the printing press can be omitted.

Another advantage is that, in order to implement the method of operating a printing press of the present invention, only a foil, which is configured to be ink-repelling, and an adhesion-imparting agent are required. In this connection, the adhesion-imparting agent replaces the attachment device of the known solutions.

In accordance with a further aspect of the present invention, there is provided a method comprising applying the foil to the impression cylinder, interposing the adhesion imparting agent and setting the rubber blanket cylinder, which is provided with a hard covering for this purpose, against the impression cylinder, which is rotating with the applied foil on it, so that the foil is pressed down uniformly until the adhesion imparting agent has cured In this way, the accuracy of applying the foil is improved further, particularly in the case of foils of high flexural strength.

Preferably, a thermoplastic material is used as the adhesion-imparting agent. For example, compounds from the group of ethylene vinyl acetate copolymers, which have a melting range approximately from 130° to 180° C. and can be adjusted by means of adding modified waxes, are suitable. In this way, the adhesion-imparting agent can even be used to repair impression cylinders, to which an intermediate dryer is assigned, and which are therefore subjected to greater heat stress. For removing the foil, such an adhesion-imparting agent merely has to be heated. For impression cylinders, to which no intermediate dryer is assigned, it is preferable to use thermoplastic adhesion imparting agents with lower melting temperatures. Another advantage of the thermoplastic adhesion imparting agents is that they do not have to be removed completely to exchange a worn foil for a new one, since residues of the adhesive have the same properties as a newly applied adhesion imparting agent and can be melted again and used to attach a new foil.

Alternatively, epoxy resins can be used as adhesion imparting agents, which cure chemically and do not require any heating. In this case, heating of the impression cylinder can be used optionally to accelerate the curing process. The adhesion-imparting agent is applied simply by brushing or spraying.

BRIEF DESCRIPTION OF THE DRAWING

The FIGURE is a diagrammatic representation of a printing unit including a double-size impression cylinder.

DESCRIPTION OF THE PREFERRED EMBODIMENT(S)

The following invention will be explained in greater detail below by means of an example.

A printing unit includes an impression cylinder 4, a rubber blanket cylinder 2 assigned to it, and the plated cylinder 1. The printing unit is an integral part of a printing press, which is not shown in the FIGURE and may comprise several printing units and a sheet turning device, the printing unit being downstream from the sheet turning device in the sheet movement direction. The impression cylinder 4 bears two gripper systems which are formed from grippers 5 and gripper stops 6, and which fix the sheets to be imprinted in place at their front edge, while they are being transported through the printing nip formed between impression cylinder 4 and rubber blanket cylinder 2.

A circumferential surface 9 of the impression cylinder 4 has an ink-repelling surface in the form of an ink-repelling structure. The ink-repelling effect can also be produced by means of a coating or a combination of structure and coating. For example, a rough structure in combination with chrome components in a foil 7 is ink-repelling. In the state shown, the rough structure of the circumferential surface 9 of the impression cylinder 4, due to continuous contact with the sheets to be printed, is already worn down to such an extent, that it no longer has sufficient ink-repelling properties.

According to the method of the present invention, a foil 7 is fastened to the circumferential surface 9. This foil is smooth on its side facing the circumferential surface 9 and has a rough, ink-repelling structure, for example, on the side facing away from the circumferential surface 9. For this purpose, once the wear limit of the original circumferential surface 9 has been reached, the circumferential surface 9 is first cleaned and subsequently, an adhesion-imparting agent 8 is sprayed onto the circumferential surface 9 and/or the underside of the foil 7. The foil 7 is pressed down by means of the rubber blanket cylinder 2, which is provided with a hard covering for this purpose and against which the rotating impression cylinder 4, on which the foil 7 has been applied, is set.

The cylinders are set against one another up to a compression of between 0.05 and 0.2 mm. The compression is increased in small steps, until the values indicated are reached, with the impression cylinder 4 performing several revolutions after every change in compression. In this process, the adhesion-imparting agent 8 is distributed uniformly; it gradually cures, with the volume remaining the same, and evens out irregularities on the impression cylinder 4. In this connection, the rubber blanket cylinder 2 with the hard covering 3 applied to it acts as the normal.

The foil 7 preferably is a metal foil, and the thickness of the applied foil 7 is not greater than 0.3 mm, so that the printing press can always print materials having thicknesses up to 1 mm.

When foils 7 are placed on the worn impression cylinder surfaces, particularly in the printing unit after the turning device, a diameter equalization to the other impression cylinders 4 before and after the turning device is advantageous, in order to avoid length differences in the printed image caused by roll-off differences. For this purpose, foils 7 having the same thickness are likewise disposed on all the other impression cylinders 4 of the printing press, with the foil surfaces being adapted to the impression cylinder surfaces in each instance. For example, a foil having a rough structure is applied to the impression cylinder after the turning device, while the impression cylinders ahead of the turning device are equipped with foils that possess a smooth chrome surface.

If, however, the foil thickness is less 0.3 mm, additional equalization foils on the other impression cylinders 4 are not absolutely necessary. Slight deviations in the length of the printed image when refitting worn impression cylinders 4 can be corrected in the case of CtP processes by means of printed image corrections within the preliminary stage of the printing.

If an impression cylinder 4 is equipped with a clamping device for foil coverings, the use of an adhesion-imparting agent 8 is not necessary. The impression cylinders 4 prepared for foil coverings have a reduced cylinder diameter, in accordance with the planned foil thickness, so that multi-layer foils having an elastic backing layer and, for example, a roughly structured functional layer with a thickness of more than 0.3 mm, can be used.

While various embodiments and individual features of the present invention have been illustrated and described, it would be obvious to those skilled in the art that various other changes and modifications can be made without departing from the spirit and scope of the present invention. As will also be apparent to those skilled in the art, various combinations of the embodiments and features taught in the foregoing description are possible and can result in preferred executions of the present invention. Accordingly, it is intended that such changes and modifications fall within the scope of the present invention as defined by the claims appended hereto.

The invention claimed is:

1. A method for operating a printing press, the printing press comprising a rubber blanket cylinder and at least one printing unit having an impression cylinder, said impression cylinder having a circumferential surface, said circumferential surface having an ink-repelling structure, said method comprising the steps of:

using said printing press to print sheets until said ink-repelling structure of said circumferential surface has been worn away to such an extent that the ink-repelling effect of said ink-repelling structure is lower than a predetermined threshold value; and placing a foil removably on said circumferential surface of said impression cylinder, said foil having an ink-repelling surface, wherein said placing step comprises:

applying an adhesion imparting agent to said foil to produce an applied foil;

contacting said adhesion imparting agent on said applied foil with said impression cylinder, resulting in said impression cylinder with said applied foil; and rotating said impression cylinder with said applied foil, whereby said applied foil is pressed down by said rubber blanket cylinder to a predetermined compression value until said adhesion imparting agent has cured.

2. The method of claim 1, wherein said ink-repelling structure is a rough structure.

3. The method of claim 1, said printing press comprising additional impression cylinders, the method further comprising removably placing one or more additional foils of equal thickness on at least one of said additional impression cylinder or cylinders of said printing press, so as to avoid length differences in the printed image.

4. The method of claim 1, characterized in that said circumferential surface of said impression cylinder and said foil have the same ink-repelling surface before wear caused by contact with the sheets.

5. The method of claim 1, said printing press further comprising a turning device, the method further comprising placing one or more foils each having a smooth surface on one or more impression cylinders before said turning device.

6. The method of claim 1, wherein said rubber blanket cylinder is provided with a hard covering, and wherein during said rotating step said hard covering is pressed against said applied foil until said adhesion imparting agent has cured.

7. The method of claim 1, characterized in that a thermoplastic material is used as said adhesion imparting agent, which is heated for applying and removing the foil.

8. The method of claim 1, characterized in that a metal foil is used.

9. The method of claim 8, characterized in that the metal foil has a thickness not greater than 0.3 mm.

10. The method of claim 8, characterized in that the foil has an elastic backing layer and a roughly structured functional layer.

11. The method of claim 1, characterized in that the foil is attached to the impression cylinder with a clamping device.

12. The method of claim 1, wherein said foil has a side averted from said circumferential surface of said impression cylinder.

13. The method of claim 1, wherein the ink-repelling surface of said foil includes at least one of a rough structure having an ink-repelling effect and an ink-repelling coating.

14. The method of claim 1, further comprising replacing said foil with an additional foil after additional sheets have been processed, when the ink-repelling surface of said foil is worn away to such an extent that the ink-repelling effect is lower than a predetermined threshold value.

15. The method of claim 1, wherein said step of placing a foil further comprises:

incrementally increasing an amount of compression between said impression and rubber blanket cylinders to said predetermined compression value during said rotating step to uniformly distribute and cure said adhesion imparting agent.

16. A method for operating a printing press, the printing press comprising a rubber blanket cylinder and at least one printing unit having an impression cylinder, said impression cylinder having a circumferential surface, said circumferential surface having an ink-repelling structure, said method comprising the steps of:

using said printing press to print sheets until said ink-repelling structure of said circumferential surface has been worn away to such an extent that the ink-repelling effect of said ink-repelling structure is lower than a predetermined threshold value; and placing a foil removably on said circumferential surface of said impression cylinder, said foil having an ink-repelling surface, wherein said placing step comprises:

applying an adhesion imparting agent to a foil to produce an applied foil;

contacting said adhesion imparting agent on said applied foil with said impression cylinder, resulting in said impression cylinder with said applied foil; and rotating said impression cylinder with said applied foil and incrementally increasing an amount of compression between said impression and rubber blanket cylinders to uniformly distribute and cure said adhesion imparting agent, whereby said applied foil is pressed down by said rubber blanket cylinder to a predetermined compression value until said adhesion imparting agent has cured.

* * * * *